US007207319B2

(12) United States Patent
Utsumi

(10) Patent No.: US 7,207,319 B2
(45) Date of Patent: Apr. 24, 2007

(54) FUEL INJECTION SYSTEM HAVING ELECTRIC LOW-PRESSURE PUMP

(75) Inventor: Yasutaka Utsumi, Hekinan (JP)

(73) Assignee: DENSO Corporation (JP)

( * ) Notice: Subject to any disclaimer, the term of this patent is extended or adjusted under 35 U.S.C. 154(b) by 155 days.

(21) Appl. No.: 11/062,568

(22) Filed: Feb. 23, 2005

(65) Prior Publication Data

US 2005/0199219 A1 Sep. 15, 2005

(30) Foreign Application Priority Data

Mar. 11, 2004 (JP) ..... 2004-069465
Mar. 11, 2004 (JP) ..... 2004-069518
Mar. 11, 2004 (JP) ..... 2004-069576

(51) Int. Cl.
*F02M 37/04* (2006.01)

(52) U.S. Cl. ..... 123/446; 123/497

(58) Field of Classification Search ..... 123/497, 123/458, 446, 447, 506
See application file for complete search history.

(56) References Cited

U.S. PATENT DOCUMENTS 4,827,897 A * 5/1989 Yamada et al. ..... 123/497
5,186,138 A * 2/1993 Hashimoto ..... 123/198 DB
5,313,924 A * 5/1994 Regueiro ..... 123/456
6,314,947 B1 * 11/2001 Roche ..... 123/525
6,397,819 B1 * 6/2002 Rembold et al. ..... 123/456
6,527,603 B1 * 3/2003 Wickman et al. ..... 440/88 F
6,536,415 B2 * 3/2003 Joos et al. ..... 123/497
6,889,656 B1 * 5/2005 Rembold et al. ..... 123/446
6,971,373 B2 * 12/2005 Mudway et al. ..... 123/497
7,100,573 B2 * 9/2006 Udd et al. ..... 123/446
2002/0092505 A1 * 7/2002 Rembold et al. ..... 123/464
2002/0157643 A1 * 10/2002 Smith et al. ..... 123/446
2003/0037768 A1 * 2/2003 Kanne et al. ..... 123/446
2004/0000289 A1 * 1/2004 Seo et al. ..... 123/447
2005/0000493 A1 * 1/2005 Yudanov ..... 123/446

FOREIGN PATENT DOCUMENTS

JP 9-209870 8/1997
JP 2000-179427 6/2000

* cited by examiner

*Primary Examiner*—Thomas Moulis
(74) *Attorney, Agent, or Firm*—Nixon & Vanderhye PC

(57) ABSTRACT

Controlling means of a fuel injection system regulates an energization amount of an electric motor in accordance with a sensing signal outputted from common rail pressure sensing means. Thus, the controlling means controls a fuel supply quantity of a low-pressure pump. Thus, power consumption of the electric motor driving the low-pressure pump can be regulated in accordance with a pressure-feeding quantity of a high-pressure pump. As a result, the power consumption of the electric motor can be reduced and wasteful fuel supply of the low-pressure pump can be reduced.

7 Claims, 5 Drawing Sheets

FUEL INJECTION SYSTEM HAVING ELECTRIC LOW-PRESSURE PUMP

CROSS REFERENCE TO RELATED APPLICATION

This application is based on and incorporates herein by reference Japanese Patent Applications No. 2004-69465 filed on Mar. 11, 2004, No. 2004-69518 filed on Mar. 11, 2004 and No. 2004-69576 filed on Mar. 11, 2004.

BACKGROUND OF THE INVENTION

1. Field of the Invention

The present invention relates to a fuel injection system for supplying fuel into an engine by injection. Specifically, the present invention relates to a fuel injection system, which draws fuel from a fuel tank with the use of an electric actuator such as an electric motor.

2. Description of Related Art

A fuel injection system for supplying fuel to an engine by injection includes a high-pressure pump, which pressurizes the fuel to a high pressure and supplies the fuel to the engine through injection valves (injectors), and a low-pressure pump, which draws the fuel from a fuel tank and supplies the fuel to the high-pressure pump. The high-pressure pump has a rotary shaft rotated by the engine. If the rotary shaft rotates, the high-pressure pump suctions and pressurizes the fuel, which is supplied by the low-pressure pump, to the high pressure, and pressure-feeds the fuel to the injectors. The low-pressure pump is attached to an end of the rotary shaft of the high-pressure pump. If the rotary shaft rotates, the low-pressure pump draws the fuel from the fuel tank and supplies the fuel to the high-pressure pump. Thus, the high-pressure pump and the low-pressure pump are driven by the engine and supply the fuel to the engine according to an engine rotation speed, or a fuel quantity required by the engine.

In recent years, a fuel injection system employing electrically-driven high-pressure pump and low-pressure pump driven by an electric actuator (for instance, an electric motor) has been proposed, for instance, as disclosed in JP-A-H09-209870 or JP-A-2000-179427, instead of the engine-driven high-pressure pump and low-pressure pump driven by the engine. The electrically-driven fuel injection system, specifically, the fuel injection system equipped with the electrically-driven low-pressure pump (the electric low-pressure pump), has advantages over the fuel injection system equipped with the engine-driven low-pressure pump as explained below.

First, the engine-driven low-pressure pump cannot supply a larger quantity of the fuel than a quantity corresponding to the engine rotation speed. Therefore, there is a possibility that the fuel supply becomes deficient in a low-rotation speed period occurring immediately after a start of the engine, for instance. In contrast, the electric low-pressure pump can supply a constant quantity of the fuel irrespective of the engine rotation speed. Therefore, the deficiency in the fuel supply does not occur in the low-rotation speed period occurring immediately after the start of the engine.

Secondly, since the engine-driven low-pressure pump is attached to the end of the rotary shaft of the high-pressure pump, the system requires another pump for filling a fuel passage leading from the fuel tank to the low-pressure pump with the fuel when the engine is restarted after an engine stall or when the engine is shipped. In contrast, the electric low-pressure pump can be mounted near the fuel tank because of a large freedom degree of a mounting position of the electric low-pressure pump. Therefore, the fuel pump for filling the fuel passage is unnecessary.

Next, an example of a fuel injection system 101 of a related art having an electric low-pressure pump 100 will be explained based on FIG. 6. The fuel injection system 101 includes a high-pressure pump 102, the low-pressure pump 100, and a common rail 105. The high-pressure pump 102 pressurizes the fuel to a high pressure and supplies the fuel to an engine. The low-pressure pump 100 is driven by an electric motor 103 as an electric actuator. Thus, the low-pressure pump 100 draws the fuel from a fuel tank 104 and supplies the fuel to the high-pressure pump 102. The common rail 105 accumulates the fuel, which is supplied by the high-pressure pump 102, at an injection pressure, at which the fuel is injected into the engine.

The high-pressure pump 102 supplies the high-pressure fuel in the common rail 105 into the engine through the common rail 105 and injection valves (injectors) 108 by injection. The high-pressure pump 102 is formed with a cam mechanism 111 driven by the engine and with pressurizing chambers 112 capable of expanding and contracting. The high-pressure pump 102 has multiple pressurizing portions 113 and a suction control valve (SCV) 114. The pressurizing portions 113 are driven by the cam mechanism 111. Thus, the pressurizing portions 113 introduce the fuel into the pressurizing chambers 112 and pressure-feed the suctioned fuel to the injectors 108. The SCV 114 regulates a suctioning quantity of the fuel suctioned into the pressurizing chambers 112 out of the fuel supplied from the low-pressure pump 100.

The cam mechanism 111 includes a rotary shaft 117, a cam 118 in the shape of a circular column, and a cam ring 119. The rotary shaft 117 is rotated by the engine. The cam 118 is eccentrically fitted to the rotary shaft 117. The cam ring 119 slidably accommodates the cam 118.

Each pressurizing portion 113 includes a plunger 123 and a spring 124. The plunger 123 is slidably accommodated in a cylinder 122 and driven by the cam mechanism 111 away from the rotary shaft 117. The spring 124 biases the plunger 123 toward the rotary shaft 117. A plunger tappet 125 is disposed on a tip end of the plunger 123 on the rotary shaft 117 side. A biasing force of the spring 124 brings the plunger tappet 125 into sliding contact with a siding surface formed on an outer periphery of the cam ring 119. The pressurizing chamber 112 is provided by an inner peripheral surface of the cylinder 122, an end surface of the plunger 123 opposite from the rotary shaft 117, and the like. The multiple pressurizing portions 113 are formed around the rotary shaft 117 at an equal angular interval (for instance, an interval of 180° or 120°).

A valve member of the SCV 114 is driven by a magnetic force generated by energization of a solenoid of the SCV 114. A value of current for the energization is controlled by duty cycle control in order to regulate a valve opening degree. If the energization of the solenoid of the SCV 114 is stopped, the valve opening degree of the SCV 114 is changed to a fully opened state or a fully closed state by a biasing force of a spring and the like.

The cam 118, the cam ring 119 and the plunger tappet 125 are accommodated in a cam chamber 128. The cam chamber 128 is supplied with part of the fuel, which is supplied from the low-pressure pump 100 and is circulated, as lubricating fuel. Thus, seizing due to the sliding contact between the cam 118 and the cam ring 119 and seizing due to the sliding contact between the plunger tappet 125 and the cam ring 119 can be prevented. A restrictor 129 limits the supply of the lubricating fuel.

If the rotary shaft 117 is rotated by the engine, the cam 118 revolves around a central axis of the rotary shaft 117. Accordingly, the plunger 123 reciprocates once in the cylinder 122 while the rotary shaft 117 makes one revolution. More specifically, if the rotary shaft 117 makes one revolution, the plunger 123 moves from a position where the volume of the pressurizing chamber 112 is maximized to another position where the volume is minimized, and then, the plunger 123 returns to the position where the volume is maximized. Meanwhile, the plunger tappet 125 slides on the sliding surface of the cam ring 119.

If the volume of the pressurizing chamber 112 is maximized, suctioning operation for suctioning the fuel into the pressurizing chamber 112 ends and fuel pressure-feeding operation for pressure-feeding the fuel from the pressurizing chamber 112 starts. Then, the fuel pressure in the pressurizing chamber 112 remains high while the volume of the pressurizing chamber 112 changes from the maximum volume to the minimum volume. Thus, the high-pressure fuel is pressure-fed from the pressurizing chamber 112 to the common rail 105. If the volume of the pressurizing chamber 112 is minimized, the pressure-feeding operation for pressure-feeding the high-pressure fuel from the pressurizing chamber 112 ends and the fuel suctioning operation for suctioning the fuel into the pressurizing chamber 112 starts. The fuel pressure in the pressurizing chamber 112 remains low while the volume of the pressurizing chamber 112 changes from the minimum volume to the maximum volume. Thus, the fuel is suctioned into the pressurizing chamber 112.

The low-pressure pump 100 is a pump having a publicly known structure, which draws the fuel from a fuel tank 104 and supplies the fuel to the high-pressure pump 102 by rotating an impeller 130 thereof. The impeller 130 of the low-pressure pump 100 is rotated by an electric motor 103 to draw the fuel from the fuel tank 104 and to supply the fuel to the high-pressure pump 102 mainly through the SCV 114. An excess quantity of the fuel out of the fuel supply quantity of the low-pressure pump 100 is released to the fuel tank 104 by a pressure regulation valve 131.

The supply quantity of the low-pressure pump 100, or a supply pressure of the low-pressure pump 100, is constant regardless of a change in the pressure-feeding quantity of the high-pressure pump 102. Therefore, the pressure regulation valve 131 regulates the pressure at an inlet of the SCV 114. More specifically, if the pressure-feeding quantity of the high-pressure pump 102 decreases, an opening degree of the pressure regulation valve 131 increases and a quantity of the fuel released to the fuel tank 104 increases. If the pressure-feeding quantity of the high-pressure pump 102 increases, the opening degree of the pressure regulation valve 131 decreases and the quantity of the fuel released to the fuel tank 104 decreases.

The fuel injection system 101 is controlled by controlling means 135.

For instance, the controlling means 135 controls an injection quantity or injection timing of the fuel injected from the injectors 108 into the respective cylinders in accordance with sensing signals of engine rotation speed sensing means 136 and accelerator position sensing means 137, which sense the requirements of the engine.

The controlling means 135 regulates the suctioning quantity of the SCV 114 so that the fuel pressure in the common rail 105 (a common rail pressure) substantially coincides with the injection pressure of the injectors 108 in accordance with a sensing signal outputted from common rail pressure sensing means 138, which senses the common rail pressure. The suctioning quantity of the SCV 114 is regulated by duty cycle control of the current value supplied to the solenoid of the SCV 114.

The electric low-pressure pump 100 of the related art needs to continuously supply the fuel corresponding to the maximum value of the fuel quantity required by the engine lest the fuel supply quantity become less than the fuel quantity required by the engine. Therefore, the fuel supply of the electric low-pressure pump 100 of the related art is wasteful and power consumption of the electric actuator is large. Therefore, a large amount of the power is required to start the engine (specifically, to energize a starter and the electric actuator 103 of the low-pressure pump 100). As a result, there is a possibility that a size of an alternator needs to be enlarged.

If the fuel injection quantity of the injectors 108 decreases, or if the fuel quantity required by the engine decreases, the valve opening degree of the SCV 114 is decreased in order to reduce the quantity of the fuel pressure-fed to the common rail 105. However, if the valve member of the SCV 114 becomes inoperative at a large valve opening degree due to clogging of extraneous matters or if the fuel leaks from a clearance between the valve member and a valve body, a larger amount of the fuel than the injection quantity of the injectors 108 is pressure-fed to the common rail 105. If an abnormally high common rail pressure occurs or if reduction of the common rail pressure delays as a result, there is a possibility that combustion noise increases.

Moreover, if the electric low-pressure pump 100 is used, there is a possibility that the fuel supply quantity of the low-pressure pump 100 changes with time due to degradation of the electric motor 103 and the like. If the fuel supply quantity of the low-pressure pump 100 changes with time, the suctioning quantity of the high-pressure pump 102, or the quantity of the fuel pressure-fed to the injectors 108, will vary even though the rotation speed of the rotary shaft 117 of the high-pressure pump 102 and the valve opening degree of the SCV 114 are the same as those provided before the change with time. As a result, there is a possibility that a difference between the fuel supply quantity supplied to the engine and the fuel quantity required by the engine increases, and exhaust gas characteristics and the like are deteriorated.

SUMMARY OF THE INVENTION

It is therefore an object of the present invention to provide a fuel injection system capable of reducing wasteful fuel supply of an electric low-pressure pump and power consumption of an electric actuator driving the low-pressure pump.

It is another object of the present invention to provide a fuel injection system using an electric low-pressure pump capable of quickly reducing a common rail pressure when the common rail pressure needs to be reduced.

It is yet another object of the present invention to provide a fuel injection system capable of substantially conforming a fuel supply quantity, which is supplied by a high-pressure pump to an engine, to a fuel quantity required by the engine even if a fuel supply quantity of a low-pressure pump changes with time due to degradation of an electric actuator and the like.

According to an aspect of the present invention, a fuel injection system includes a high-pressure pump, a low-pressure pump and controlling means. The high-pressure pump pressurizes fuel to a high pressure and supplies the fuel to an engine. The low-pressure pump is driven by an electric actuator. Thus, the low-pressure pump draws the fuel from a fuel tank and supplies the fuel to the high-pressure pump. The controlling means controls a fuel supply quantity of the low-pressure pump by regulating an energization amount of the electric actuator.

Thus, the energization amount of the electric actuator driving the low-pressure pump can be regulated in accordance with a fuel quantity required by the engine. As a result, power consumption of the electric actuator can be reduced and wasteful fuel supply of the low-pressure pump can be reduced.

According to another aspect of the present invention, the controlling means of the fuel injection system stops the fuel supply of the low-pressure pump by stopping the energization of the electric actuator in a common rail pressure reduction period, in which a common rail pressure is reduced.

Thus, the fuel supply of the low-pressure pump can be stopped when the common rail pressure needs to be reduced quickly, for instance, when an abnormally high common rail pressure occurs. As a result, an increase of combustion noise and the like can be prevented by quickly reducing the common rail pressure.

According to yet another aspect of the present invention, the fuel injection system includes low-pressure pump supply pressure sensing means for sensing a fuel supply pressure of the low-pressure pump. The controlling means of the fuel injection system controls a valve opening degree of a suction control valve in accordance with a sensing signal outputted by the low-pressure pump supply pressure sensing means.

The fuel supply pressure of the low-pressure pump changes in accordance with the fuel supply quantity of the low-pressure pump. Therefore, the control can be performed in accordance with the fuel supply quantity of the low-pressure pump by using the sensing signal outputted by the low-pressure pump supply pressure sensing means.

Thus, by controlling the valve opening degree of the suction control valve in accordance with the sensing signal outputted by the low-pressure pump supply pressure sensing means, the fuel supply quantity supplied by the high-pressure pump to the engine can be substantially conformed to the fuel quantity required by the engine even if the fuel supply quantity of the low-pressure pump changes with time.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS (First Embodiment)

Figure 1:
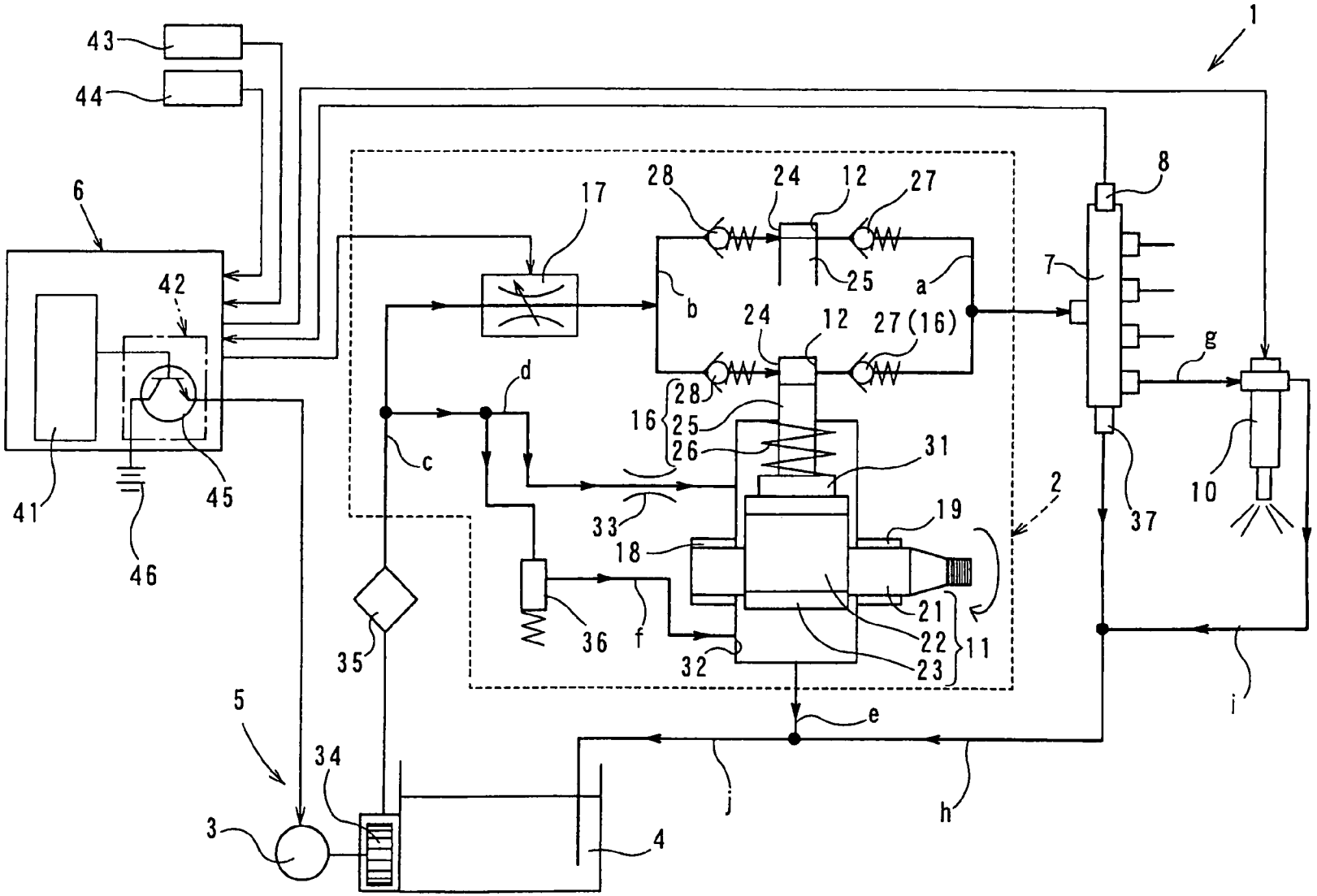
FIG. 1 is a schematic diagram showing a fuel injection system according to a first embodiment of the present invention.

Referring to FIG. 1, a fuel injection system 1 according to a first embodiment of the present invention is illustrated.

As shown in FIG. 1, the fuel injection system 1 includes a high-pressure pump 2, a low-pressure pump 5, controlling means 6, a common rail 7 and common rail pressure sensing means 8. The high-pressure pump 2 pressurizes fuel to a high pressure and supplies the fuel to an engine. The low-pressure pump 5 is driven by an electric motor 3 as an electric actuator. Thus, the low-pressure pump 5 draws the fuel from a fuel tank 4 and supplies the fuel to the high-pressure pump 2. The controlling means 6 controls the fuel injection system 1. The controlling means 6 controls a fuel supply quantity of the low-pressure pump 5 by regulating an energization amount of the electric motor 3. The common rail 7 accumulates the fuel, which is supplied from the high-pressure pump 2, in a high-pressure state. The common rail pressure sensing means 8 senses a fuel pressure in the common rail 7 (a common rail pressure).

The high-pressure pump 2 supplies the high-pressure fuel in the common rail 7 into the engine through the common rail 7 and injection valves (injectors) 10 by injection. The high-pressure pump 2 is formed with a cam mechanism 11 driven by the engine and pressurizing chambers 12 capable of expanding and contracting. The high-pressure pump 2 has multiple pressurizing portions 16 and a suction control valve (SCV) 17. The pressurizing portions 16 are driven by the cam mechanism 11. Thus, the pressurizing portions 16 suction the fuel into the pressurizing chambers 12 and pressure-feed the suctioned fuel to the injectors 10. The SCV 17 regulates a suctioning quantity of the fuel suctioned into the pressurizing chambers 12 out of the fuel supplied from the low-pressure pump 5.

The cam mechanism 11 includes a rotary shaft 21, a cam 22 in the shape of a circular column, and a cam ring 23. The rotary shaft 21 is rotatably held by bearings 18, 19 and is rotated by the engine. The cam 22 is eccentrically mounted to the rotary shaft 21. The cam ring 23 slidably accommodates the cam 22.

Each pressurizing portion 16 includes a plunger 25, a spring 26, a pressure-feeding side check valve 27 and a suction side check valve 28. The plunger 25 is slidably accommodated in a cylinder 24 and driven by the cam mechanism 11 away from the rotary shaft 21. The spring 26 biases the plunger 25 toward the rotary shaft 21. The pressure-feeding side check valve 27 is mounted in a fuel passage "a" between the pressurizing chamber 12 and the common rail 7 for preventing a backflow of the fuel from the common rail 7 toward the pressurizing chamber 12. The suction side check valve 28 is mounted in a fuel passage "b" between the pressurizing chamber 12 and the SCV 17 for preventing a backflow of the fuel from the pressurizing chamber 12 toward the SCV 17. A plunger tappet 31 is disposed on a tip end of the plunger 25 on the rotary shaft 21 side. A biasing force of the spring 26 brings the plunger tappet 31 into sliding contact with a siding surface formed on an outer periphery of the cam ring 23.

The pressurizing chamber 12 is provided by an inner peripheral surface of the cylinder 24, an end surface of the plunger 25 opposite from the rotary shaft 21, and the like. The multiple pressurizing portions 16 are formed around the rotary shaft 21 at an equal angular interval (for instance, an interval of 180° or 120°). The multiple fuel passages "a" extending from the multiple pressure-feeding side check valves 27 merge into a passage, which is connected with the common rail 7.

The cam 22, the cam ring 23 and the plunger tappet 31 are accommodated in a cam chamber 32. The cam chamber 32 is supplied with part of the fuel, which is supplied from the low-pressure pump 5 and circulated, as lubricating fuel. Thus, seizing due to the sliding contact between the cam 22 and the cam ring 23 and seizing due to the sliding contact between the plunger tappet 31 and the cam ring 23 can be prevented. The lubricating fuel is supplied to the cam chamber 32 through a fuel passage "d" branching from a fuel passage "c" leading from the low-pressure pump 5 to the SCV 17. A restrictor 33 for limiting the supply of the lubricating fuel is disposed in the fuel passage "d" in order to prevent occurrence of troubles in the fuel suction into the pressurizing chambers 12. The lubricating fuel supplied to the cam chamber 32 returns to the fuel tank 4 through a fuel passage "e".

Next, operation of the cam mechanism 11 and the pressurizing portions 16 will be explained. If the rotary shaft 21 is rotated by the engine, the cam 22 revolves around a central axis of the rotary shaft 21. The plunger 25 reciprocates in the cylinder 24 once if the rotary shaft 21 makes one revolution. More specifically, if the rotary shaft 21 makes one revolution, the plunger 25 moves from a position where the volume of the pressurizing chamber 12 is maximized to another position where the volume is minimized, and then, the plunger 25 returns to the position where the volume is maximized. Meanwhile, the plunger tappet 31 slides on the sliding surface of the cam ring 23.

Next, the fuel suctioning operation and fuel pressure-feeding operation accompanying the operation of the cam mechanism 11 and the pressurizing portions 16 will be explained. If the volume of the pressurizing chamber 12 is maximized, the suctioning operation for suctioning the fuel into the pressurizing chamber 12 ends and the suction side check valve 28 is closed. Meanwhile, the pressure-feeding side check valve 27 is opened and the pressure-feeding operation for pressure-feeding the fuel from the pressurizing chamber 12 starts. Then, the fuel pressure in the pressurizing chamber 12 remains high while the volume of the pressurizing chamber 12 changes from the maximum volume to the minimum volume. Thus, the high-pressure fuel is pressure-fed from the pressurizing chamber 12 to the common rail 7. If the volume of the pressurizing chamber 12 is minimized, the pressure-feeding operation of the high-pressure fuel from the pressurizing chamber 12 ends and the pressure-feeding side check valve 27 is closed. Meanwhile, the suction side check valve 28 is opened and the fuel suctioning operation into the pressurizing chamber 12 starts. The fuel pressure in the pressurizing chamber 12 remains low while the volume of the pressurizing chamber 12 changes from the minimum volume to the maximum volume. Thus, the fuel is suctioned into the pressurizing chamber 12.

The SCV 17 regulates the fuel suctioning quantity of the fuel suctioned into the pressurizing chambers 12 of the high-pressure pump 2 out of the fuel supplied from the low-pressure pump 5. A valve member of the SCV 17 is driven by a magnetic force caused by energizing a solenoid of the SCV 17. A current value of the energization is controlled by duty cycle control to regulate a valve opening degree as explained after. If the energization of the solenoid is stopped, the valve opening degree of the SCV 17 is changed to a fully opened state or a fully closed state by a biasing force of a spring and the like.

The low-pressure pump 5 is a pump having a publicly known structure, which draws the fuel from the fuel tank 4 and supplies the fuel to the high-pressure pump 2 by rotating an impeller 34 thereof. The impeller 34 of the low-pressure pump 5 is rotated by the electric motor 3 to draw the fuel from the fuel tank 4 and to supply the fuel to the high-pressure pump 2. A fuel filter 35 is disposed in the fuel passage "c" leading from the low-pressure pump 5 to the SCV 17 for eliminating extraneous matters contained in the fuel supplied by the low-pressure pump 5. Excess fuel, which does not pass through the SCV 17 and the restrictor 33, out of the fuel supplied from the low-pressure pump 5 returns to the fuel tank 4 through a fuel passage "f" branching from the fuel passage "d" and the cam chamber 32. A pressure regulation valve 36 for releasing the excess fuel is disposed in the fuel passage "f".

The common rail 7 is a pressure accumulation vessel for accumulating the fuel, which is supplied from the high-pressure pump 2, at a common rail pressure corresponding to a fuel injection pressure of the injectors 10. The common rail 7 is connected with the multiple injectors 10, which are mounted to respective cylinders of the engine, through multiple fuel passages "g". If a solenoid of the injector 10 is energized, a valve member is driven by a magnetic force caused by the energization. Thus, a valve hole is opened. If the energization is stopped, the valve member is driven by a biasing force of a spring and the like, and the valve hole is closed. The fuel in the common rail 7 is injected into the cylinder by opening the valve hole.

The common rail 7 has a pressure limiter 37 for limiting the common rail pressure to a limit pressure or under. The pressure limiter 37 operates if the common rail pressure exceeds a predetermined set value. The pressure limiter 37 intermittently releases the fuel in the common rail 7 to the fuel tank 4 through a fuel passage "h" until the common rail pressure is stabilized under the set value. Excess fuel from the injectors 10 returns to the fuel tank 4 through fuel passages "i" merging with the fuel passage "h". The fuel passage "e" and the fuel passage "h" merge into one fuel passage "j", which is connected with the fuel tank 4.

The common rail pressure sensing means 8 is a pressure sensor, which has a publicly known structure and is attached to the common rail 7.

The controlling means 6 includes an electronic control unit (ECU) 41, an injector drive circuit, an SCV drive circuit, a low-pressure pump drive circuit 42 and the like. The ECU 41 includes a computer equipped with CPU for performing control processing and arithmetic processing, a memory device for storing various types of programs and data, an input device, an output device and the like. The injector drive circuit energizes the solenoids of the injectors 10. The SCV drive circuit energizes the solenoid of the SCV 17. The low-pressure pump drive circuit 42 energizes the electric motor 3 of the low-pressure pump 5. The controlling means 6 receives sensing signals from engine rotation speed sensing means 43, accelerator position sensing means 44, the common rail pressure sensing means 8 and the like. The engine rotation speed sensing means 43 senses a signal used to measure an engine rotation speed. The accelerator position sensing means 44 senses a signal used to measure an accelerator position. The controlling means 6 performs the various types of the control based on the sensing signals.

For instance, the controlling means 6 controls an injection quantity and injection timing of the fuel injected from the injectors 10 into the respective cylinders of the engine in accordance with the requirements of the engine such as the engine rotation speed or the accelerator position. More specifically, the controlling means 6 calculates the injection quantity (an injection quantity command value) and the injection timing (an injection timing command value) of the fuel injected from the injectors 10 into the cylinders based on the sensing signals outputted by the engine rotation speed sensing means 43, the accelerator position sensing means 44 and the like. Then, the controlling means 6 performs the energization of the solenoids of the injectors 10 based on the calculated injection quantity command value and the injection timing command value. Thus, the injectors 10 inject the fuel into the respective cylinders.

The controlling means 6 regulates the pressure-feeding quantity of the high-pressure pump 2 (the suctioning quantity of the SCV 17) so that the common rail pressure substantially coincides with the injection pressure of the injectors 10. More specifically, the controlling means 6 calculates an SCV drive current (an SCV drive current command value), which is supplied to the solenoid of the SCV 17, in accordance with the sensing signal inputted by the common rail pressure sensing means 8. Then, the controlling means 6 synthesizes a control signal of a duty ratio corresponding to the calculated SCV drive current command value. Then, the solenoid of the SCV 17 is energized with the control signal, and the valve opening degree of the SCV 17 is regulated. Thus, the suctioning quantity of the SCV 17, or the pressure-feeding quantity of the high-pressure pump 2, is regulated.

The controlling means 6 of the present embodiment regulates the energization amount of the electric motor 3 in accordance with the common rail pressure to control the supply quantity of the low-pressure pump 5. More specifically, the ECU 41 measures the common rail pressure with the use of the sensing signal inputted by the common rail pressure sensing means 8. Then, the ECU 41 calculates a motor drive current (a motor drive current command value), which is supplied to the electric motor 3, in accordance with the difference between the measured value and a target value of the common rail pressure. Then, the ECU 41 synthesizes a control signal of a duty ratio corresponding to the calculated motor drive current command value and outputs the control signal to the low-pressure pump drive circuit 42. A transistor 45 for energizing the electric motor 3 included in the low-pressure pump drive circuit 42 performs switching operation responsive to the control signal. Thus, the current substantially equal to the motor drive current command value is supplied from a battery 46 to the electric motor 3. By regulating the energization amount of the electric motor 3, a rotation speed of the impeller 34 is regulated and the fuel supply quantity of the low-pressure pump 5 is controlled.

As explained above, the controlling means 6 of the first embodiment regulates the energization amount of the electric motor 3 in accordance with the measured value of the common rail pressure. Thus, the fuel supply quantity of the low-pressure pump 5 is controlled.

Figure 2A:
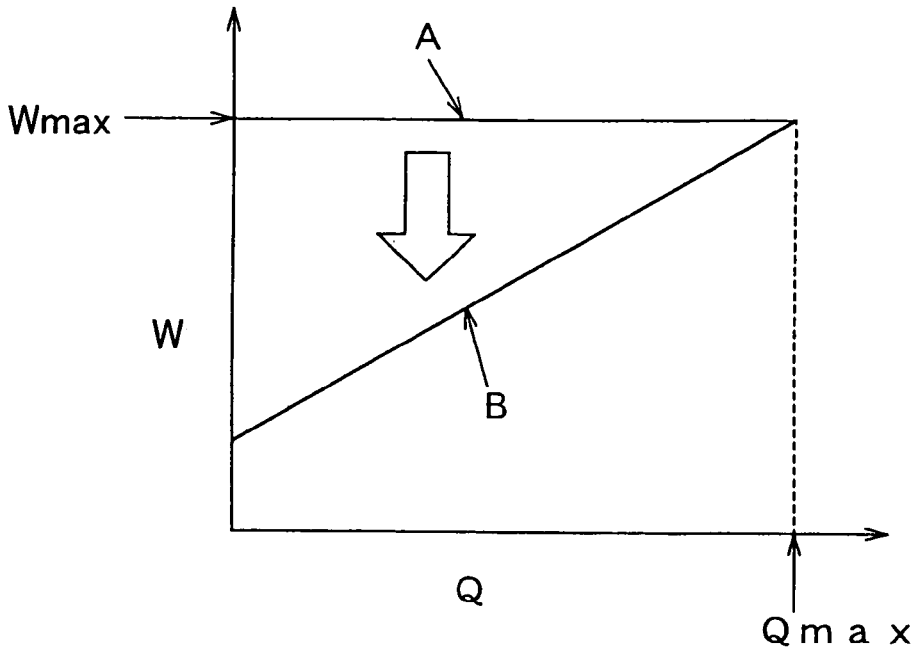
FIG. 2A is a graph showing a correlation between a pressure-feeding quantity of a high-pressure pump and power consumption of an electric motor according to the first embodiment.

Thus, the power consumption of the electric motor 3 driving the low-pressure pump 5 can be regulated in accordance with the pressure-feeding quantity of the high-pressure pump 2. As a result, the power consumption W of the electric motor 3 and the wasteful fuel supply of the low-pressure pump 5 can be reduced as shown in FIGS. 2A and 2B.

Figure 2B:
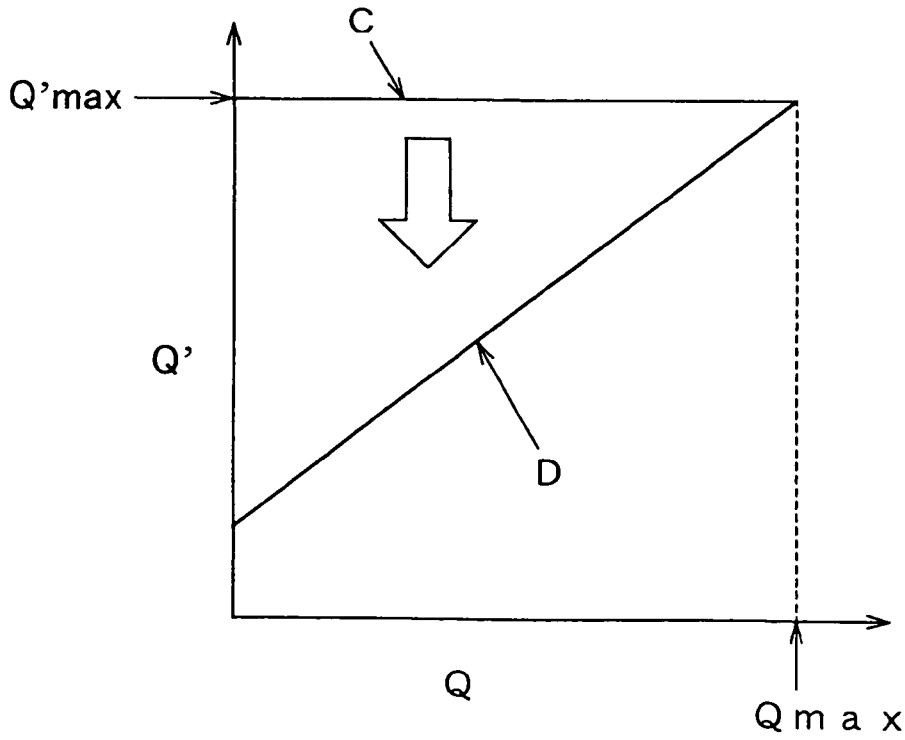
FIG. 2B is a graph showing a correlation between the pressure-feeding quantity of the high-pressure pump and a fuel supply quantity of a low-pressure pump according to the first embodiment.

More specifically, the low-pressure pump of the related art supplies the fuel of a constant quantity Q'max corresponding to the maximum pressure-feeding quantity Qmax of the high-pressure pump as shown by a solid line C in FIG. 2B, irrespective of the pressure-feeding quantity Q of the high-pressure pump 2. Therefore, the power consumption W of the electric motor is a constant value Wmax as shown by a solid line A in FIG. 2A. In contrast, in the first embodiment, by regulating the energization amount of the electric motor 3 in accordance with the common rail pressure, the power consumption W of the electric motor 3 can be regulated in accordance with the pressure-feeding quantity Q of the high-pressure pump 2 as shown by a solid line B in FIG. 2A. Likewise, the supply quantity Q' of the low-pressure pump 5 can be controlled in accordance with the pressure-feeding quantity Q of the high-pressure pump 2 as shown by a solid line D in FIG. 2B.

(Second Embodiment)

Next, a fuel injection system 1 according to a second embodiment of the present invention will be explained based on FIG. 3.

The ECU 41 of the fuel injection system 1 of the second embodiment synthesizes a motor drive signal for driving the electric motor 3 and outputs the motor drive signal to the low-pressure pump drive circuit 42 when the fuel needs to be pressure-fed to the common rail 7. Responsive to the motor drive signal, the transistor 45 included in the low-pressure pump drive circuit 42 for energizing the electric motor 3 operates to energize the electric motor 3 with the use of the battery 46. Thus, the impeller 34 rotates at a predetermined rotation speed and a predetermined quantity of the fuel is supplied by the low-pressure pump 5.

If the ECU 41 determines that the state of the fuel injection system 1 is in a common rail pressure reduction period based on a transition of the injection quantity command value and the like, the ECU 41 stops synthesizing and outputting the motor drive signal. The common rail pressure reduction period is a period in which the common rail pressure is reduced responsive to a command of the ECU 41. Thus, the transistor 45 is stopped and the power supply from the battery 46 to the electric motor 3 is stopped. Accordingly, the fuel supply by the low-pressure pump 5 stops. The ECU 41 determines that the common rail pressure reduction period occurs if the injection quantity command value is on the decrease, or if the fuel quantity required by the engine decreases, for instance. Thus, the controlling means 6 stops the energization of the electric motor 3 to stop the fuel supply of the low-pressure pump 5 in the common rail pressure reduction period.

As explained above, the controlling means 6 of the second embodiment stops synthesizing and outputting the motor drive signal if the controlling means 6 determines that the state of the fuel injection system 1 is in the common rail pressure reduction period.

Thus, the energization of the electric motor 3 stops and the fuel supply of the low-pressure pump 5 stops. Accordingly, the common rail pressure can be reduced quickly.

Figure 3:
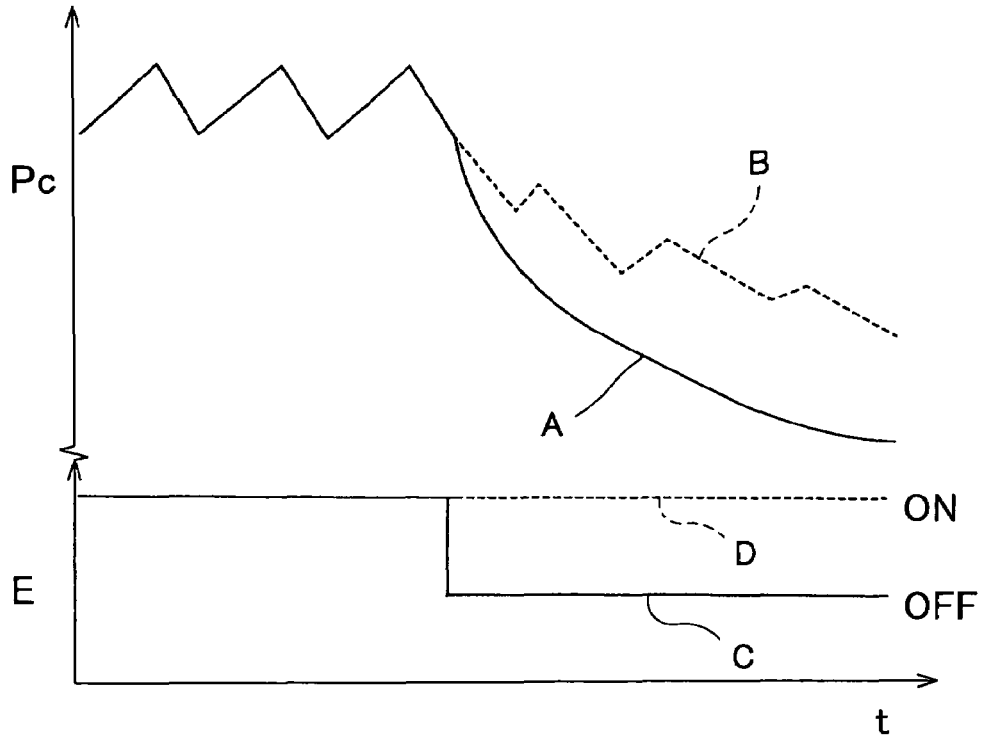
FIG. 3 is a time chart showing transitions of a common rail pressure and an energization state of an electric motor of a fuel injection system according to a second embodiment of the present invention.

For instance, as shown in FIG. 3, a time for the common rail pressure Pc to decrease to a new injection pressure is shorter in the case where the energization of the electric motor 3 is stopped when the fuel leak is caused by clogging of extraneous matters in the SCV 17 and the like than in the case where the energization of the electric motor 3 is not stopped. The common rail pressure Pc and the energization state E of the electric motor 3 in the case where the energization of the electric motor 3 is stopped are shown by a solid line A and a solid line C in FIG. 3 respectively. The common rail pressure Pc and the energization state E in the case where the energization of the electric motor 3 is not stopped are shown by a broken line B and a broken line D in FIG. 3 respectively.

The controlling means 6 of the second embodiment determines that the state of the fuel injection system 1 is in the common rail pressure reduction period if the injection quantity command value is on the decrease, or if the fuel quantity required by the engine decreases.

Thus, the injection pressure can be quickly reduced when the fuel quantity required by the engine decreases. As a result, response of the engine control can be improved.

(Third Embodiment)

Next, a fuel injection system 1 according to a third embodiment of the present invention will be explained based on FIGS. 4 and 5.

Figure 4:
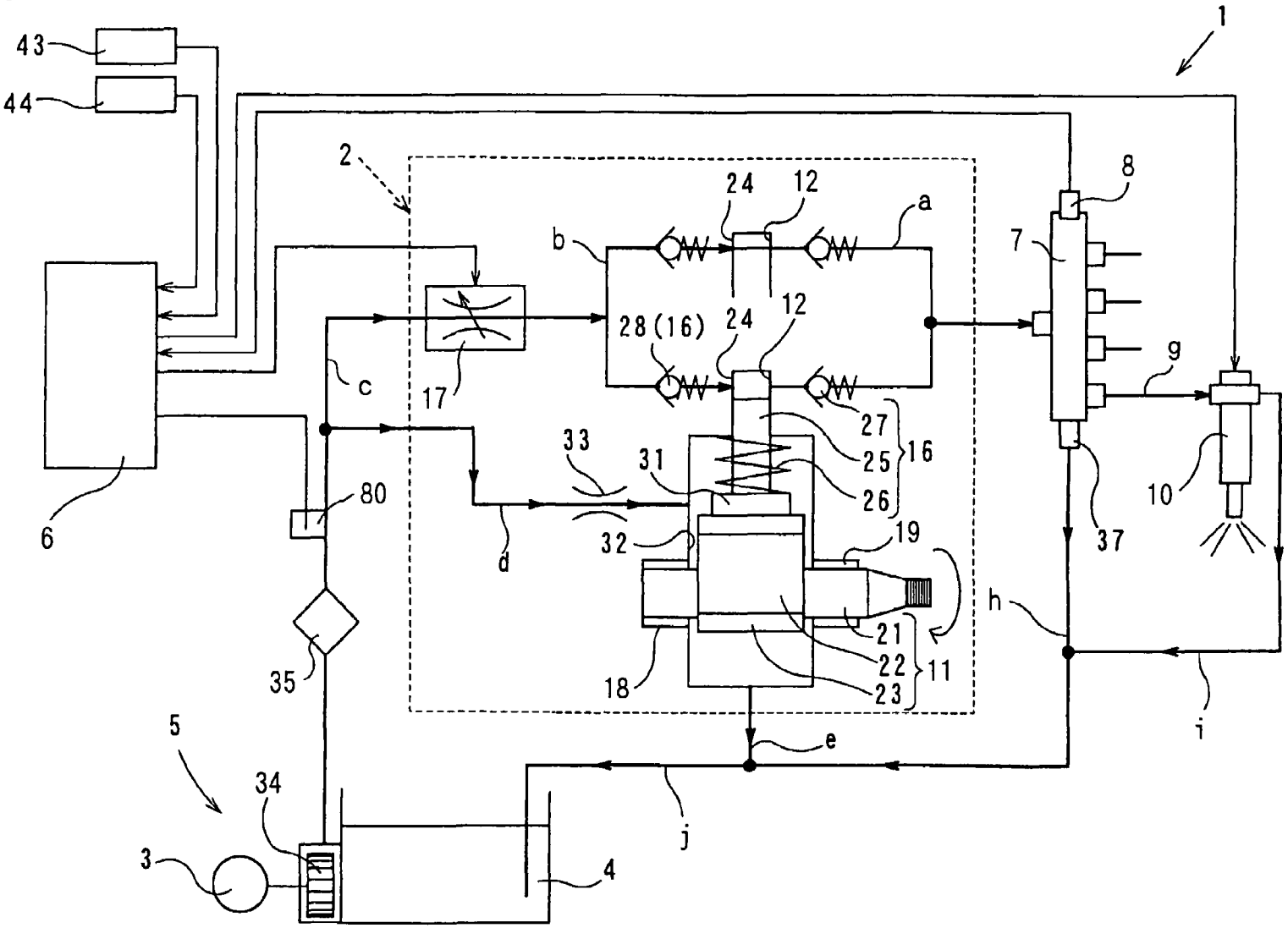
FIG. 4 is a schematic diagram showing a fuel injection system according to a third embodiment of the present invention.
Figure 6:
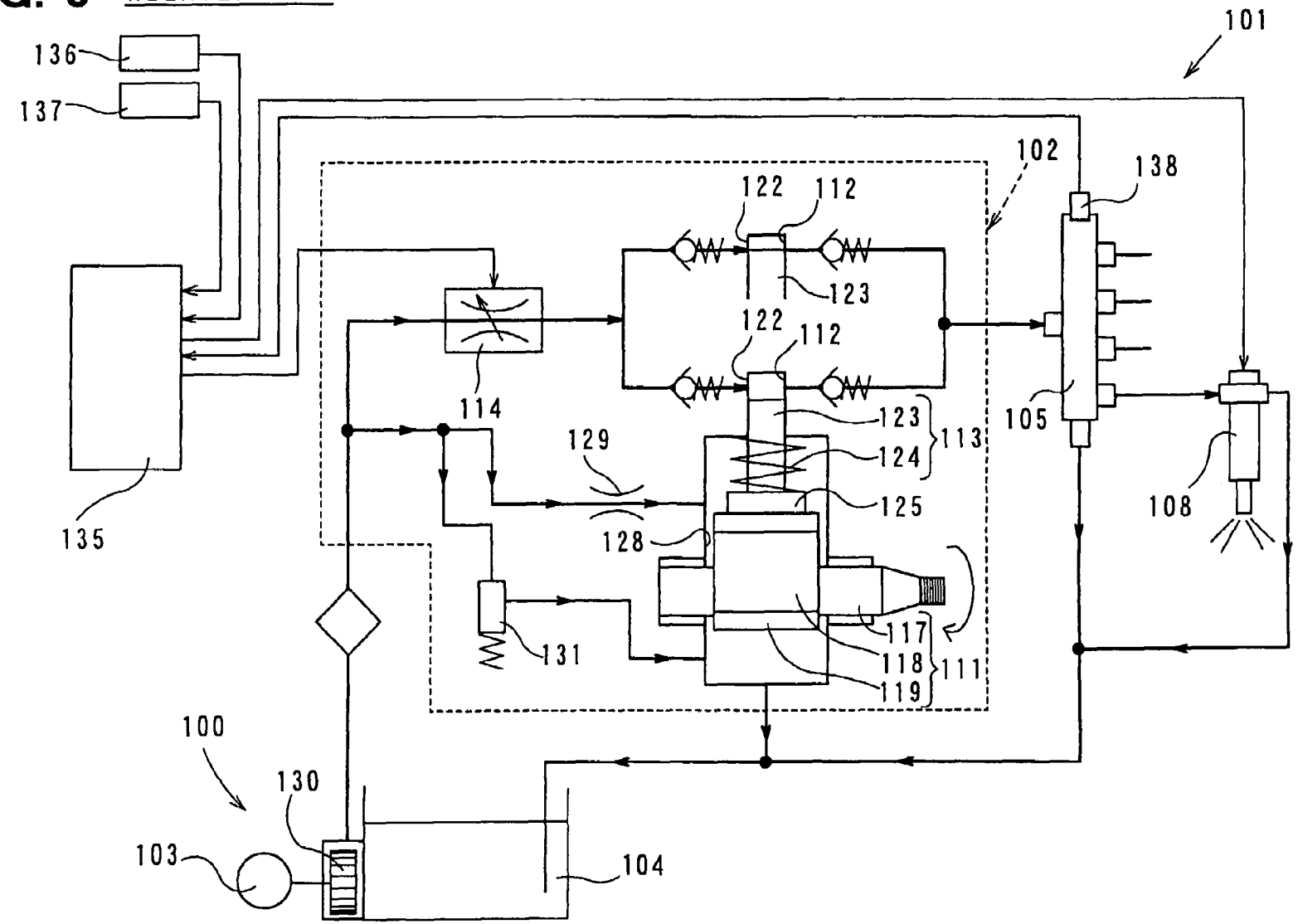
FIG. 6 RELATED ART
FIG. 6 is a schematic diagram showing a fuel injection system of a related art.

The fuel injection system 1 of the third embodiment shown in FIG. 4 includes low-pressure pump supply pressure sensing means 80 for sensing the fuel supply pressure of the low-pressure pump 5. The controlling means 6 controls the valve opening degree of the SCV 17 based on a sensing signal outputted by the low-pressure pump supply pressure sensing means 80.

The low-pressure pump supply pressure sensing means 80 is a publicly known pressure sensor attached to the fuel passage "c" between the fuel filter 35 and the SCV 17. The low-pressure pump supply pressure sensing means 80 senses the fuel pressure in the fuel passage "c", or the supply pressure (a low-pressure pump supply pressure) of the low-pressure pump 5 on the downstream side of the fuel filter 35.

The controlling means 6 of the third embodiment controls the valve opening degree of the SCV 17 based on the sensing signal outputted from the low-pressure pump supply pressure sensing means 80, in addition to the sensing signal outputted from the common rail pressure sensing means 8. More specifically, the controlling means 6 calculates the SCV drive current command value by correcting the SCV drive current, which is calculated mainly in accordance with the measured value of the common rail pressure, based on the measured value of the low-pressure pump supply pressure.

Figure 5:
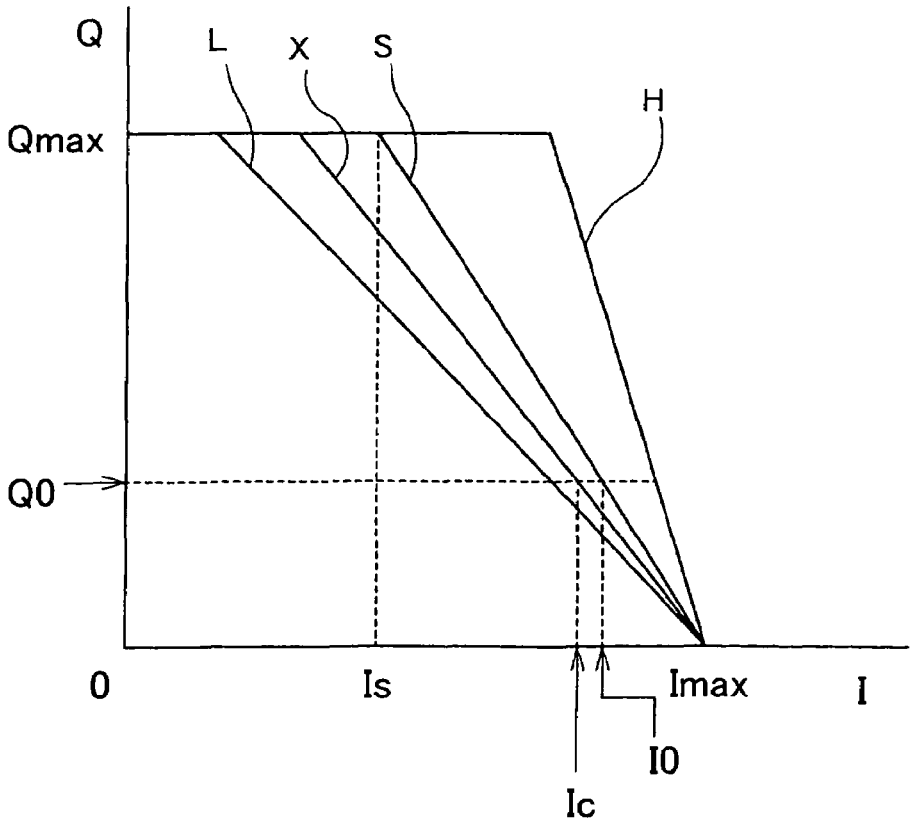
FIG. 5 is a graph showing a correlation between suction control valve drive current and a pressure-feeding quantity of a high-pressure pump according to the third embodiment.

This correction is performed based on an SCV drive current correction map (a correction map) shown in FIG. 5. The correction map shows a correlation between the SCV drive current I and the pressure-feeding quantity Q of the high-pressure pump 2 (the suctioning quantity of the high-pressure pump 2 or the suctioning quantity of the SCV 17). A standard line S in FIG. 5 represents the correlation between the SCV drive current I and the pressure-feeding quantity Q of the high-pressure pump 2 in a state in which the fuel supply quantity of the low-pressure pump 5 has not changed with time. More specifically, the standard line S represents the correlation between the drive current I and the pressure-feeding quantity Q of the high-pressure pump 2 in a state in which the low-pressure pump supply pressure is a value (a standard value) provided when the low-pressure pump supply pressure has not changed with time. A high-pressure line H in FIG. 5 represents the correlation between the SCV drive current I and the pressure-feeding quantity Q of the high-pressure pump 2 in a state in which the low-pressure pump supply pressure is higher than the standard value by a value ΔP (a positive value). A low-pressure line L in FIG. 5 represents the correlation between the SCV drive current I and the pressure-feeding quantity Q of the high-pressure pump 2 in a state in which the low-pressure pump supply pressure is lower than the standard value by the value ΔP.

The correction map of FIG. 5 shows the correlation between the SCV drive current I and the pressure-feeding quantity Q of a normally open type suction control valve, which maximizes the pressure-feeding quantity Q of the high-pressure pump 2 when the SCV drive current I is zero. As shown by the standard line S, the valve hole is in a fully opened state and the maximum pressure-feeding quantity Qmax of the fuel is pressure-fed by the high-pressure pump 2 unless the SCV drive current I exceeds a threshold value Is. If the SCV drive current I exceeds the threshold value Is, the valve hole starts closing and the pressure-feeding quantity Q of the high-pressure pump 2 decreases gradually. If the SCV drive current I reaches a predetermined value Imax, the valve hole is brought to the fully closed state and the pressure-feeding quantity Q of the high-pressure pump 2 becomes zero.

Next, a correcting method of the SCV drive current I will be explained. First, a tentative SCV drive current I0 is calculated in accordance with the measured value of the common rail pressure and the like on the premise that the fuel supply quantity of the low-pressure pump 5 has not changed with time. Then, the pressure-feeding quantity Q0 of the high-pressure pump 2 is calculated by applying the tentative SCV drive current I0 to the standard line S. Then, a correction line X is drawn on the correction map in accordance with a difference ϵ between the measured value and the standard value of the low-pressure pump supply pressure. The correction line X is drawn between the high-pressure line H and the standard line S when the difference ϵ is a positive value. The correction line X is drawn between the low-pressure line L and the standard line S when the difference ϵ is a negative value. The correction line X in the case where the difference ϵ is a negative value is shown in FIG. 5. By applying the calculated value of the pressure-feeding quantity Q to the correction line X, the SCV drive current I is newly calculated. The newly calculated SCV drive current I is employed as the SCV drive current command value Ic.

The controlling means 6 of the third embodiment calculates the SCV drive current command value Ic by correcting the SCV drive current I, which is calculated mainly in accordance with the measured value of the common rail pressure, based on the measured value of the low-pressure pump supply pressure.

Thus, even if the fuel supply quantity of the low-pressure pump 5 changes with time due to the degradation of the electric motor 3 and the like, the suctioning quantity of the SCV 17 can be regulated in accordance with the fuel supply quantity of the low-pressure pump 5. As a result, even if the fuel supply quantity of the low-pressure pump 5 changes with time, the fuel supply quantity supplied by the high-pressure pump 2 to the engine can be substantially conformed to the fuel quantity required by the engine.

Moreover, the influence of the low-pressure pump supply pressure is reflected in the valve opening degree of the SCV 17. Therefore, the pressure regulation valve 36 used in the first and second embodiments is unnecessary in the third embodiment.

The low-pressure pump supply pressure sensing means 80 of the third embodiment senses the fuel pressure in the fuel passage "c" connecting the fuel filter 35 with the SCV 17.

Thus, the low-pressure pump supply pressure reflecting the clogging of the fuel filter 35 and the like can be measured. As a result, the control reliability of the SCV 17 can be improved further.

(Modifications)

In the first embodiment, the controlling means 6 regulates the energization amount of the electric motor 3 by performing the duty cycle control of the control signal, by which the electric motor 3 is driven. Alternatively, the energization amount of the electric motor 3 may be regulated with the use of a variable resistor.

The controlling means 6 of the first embodiment regulates the energization amount of the electric motor 3 in accordance with the measured value of the common rail pressure. Alternatively, the energization amount of the electric motor 3 may be regulated in accordance with the injection quantity command value of the injectors 10, the SCV drive current command value, or a duty ratio corresponding to the SCV drive current.

The fuel injection system 1 of the second embodiment stops the fuel supply of the low-pressure pump 5 if the injection quantity command value is on the decrease, or if the fuel quantity required by the engine decreases. Alternatively, the fuel injection system 1 may determine that the common rail pressure reduction period occurs and may stop the fuel supply of the low-pressure pump 5 if the common rail pressure abnormally increases when the pressure limiter 37 becomes inoperative.

The controlling means 6 of the above embodiments is applied to the pressure accumulation type fuel injection system 1, which injects the fuel into the engine through the common rail 7 accumulating the high-pressure fuel. Alternatively, the controlling means 6 of the above embodiments may be applied to a fuel injection system injecting the fuel into the engine not through a common rail.

The present invention should not be limited to the disclosed embodiments, but may be implemented in many other ways without departing from the spirit of the invention.

What is claimed is:

1. A fuel injection system for supplying fuel into an engine by injection, the fuel injection system comprising:

a high-pressure pump for pressurizing the fuel to a high pressure and for supplying the fuel to the engine;

a low-pressure pump driven by an electric actuator for drawing the fuel from a fuel tank and for supplying the fuel to the high-pressure pump;

a suction control valve for regulating a suctioning quantity of the fuel suctioned into the high-pressure pump out of the fuel supplied by the low-pressure pump;

low-pressure pump supply pressure sensing means for sensing a fuel supply pressure of the low-pressure pump; and controlling means for controlling a valve opening degree of the suction control valve in accordance with a sensing signal outputted by the low-pressure pump supply pressure sensing means.

2. The fuel injection system as in claim 1, further comprising:

a fuel filter for eliminating extraneous matters contained in the fuel supplied by the low-pressure pump, wherein the low-pressure pump supply pressure sensing means senses the supply pressure by sensing a fuel pressure in a fuel passage connecting the fuel filter with the suction control valve.

3. A fuel injection system as in claim 1, wherein the valve opening degree of the suction control valve is controlled in accordance with the sensed value of the fuel supply pressure of the low-pressure pump correlated with the fuel supply amount of the low-pressure pump.

4. A fuel injection system for supplying fuel into an engine by injection, the fuel injection system comprising:

a high-pressure pump for pressurizing fuel to a high pressure and for supplying the fuel to the engine;

a low-pressure pump driven by an electric actuator for drawing fuel from a fuel tank and for supplying the fuel to the high-pressure pump;

a suction control valve for regulating a suctioning quantity of the fuel suctioned into the high-pressure pump out of the fuel supplied by the low-pressure pump;

a low-pressure pump supply pressure sensor to sense a fuel supply pressure of the low-pressure pump; and a controller to control a valve opening degree of the suction control valve in accordance with a sensing signal outputted by the low-pressure pump supply pressure sensor.

5. The fuel injection system as in claim 4, further comprising:

a fuel filter for eliminating extraneous matters contained in the fuel supplied by the low-pressure pump, wherein the low-pressure pump supply pressure sensor senses the supply pressure by sensing a fuel pressure in a fuel passage connecting the fuel filter with the suction control valve.

6. A method for supplying fuel into an engine by injection using a fuel injection system including a high pressure pump for pressurizing fuel to a high pressure and supplying the fuel to the engine, a low pressure pump for drawing fuel from a fuel tank and supplying the fuel to the high pressure pump, and a suction control valve to regulate a suction quantity of fuel sucked into the high pressure pump out of the fuel supplied by the low pressure pump, the method comprising:

drawing fuel from a fuel tank with the low pressure pump and supplying the fuel to the high pressure pump via the suction control valve;

sensing a fuel supply pressure of the low-pressure pump; and controlling a valve opening degree of the suction control valve in accordance with said fuel supply pressure.

7. A method as in claim 6, further comprising filtering the fuel supplied by the low pressure pump with a fuel filter to eliminate extraneous matters contained in the fuel and wherein fuel supply pressure is sensed in a fuel passage connecting the fuel filter with the suction control valve.

* * * * *